US007591706B2

(12) United States Patent
Barbour et al.

(10) Patent No.: US 7,591,706 B2
(45) **Date of Patent: *Sep. 22, 2009**

(54) REVERSIBLE SPORT BRA

(75) Inventors: Dawn Barbour, Baltimore, MD (US); Colleen McCann, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/938,589

(22) Filed: Nov. 12, 2007

(65) Prior Publication Data

US 2008/0070477 A1 Mar. 20, 2008

Related U.S. Application Data

(63) Continuation of application No. 10/901,231, filed on Jul. 29, 2004, now Pat. No. 7,306,505.

(51) Int. Cl.
*A41C 3/08* (2006.01)
*A41C 3/00* (2006.01)

(52) U.S. Cl. ..... 450/23; 450/30; 450/31; 2/106; 2/DIG. 2

(58) Field of Classification Search ..... 450/155, 450/94–112, 1, 7–11, 15–18, 23–28, 30–35; 2/102–110, 114, 115, 80, 83, 85, 90, 93–95, 2/105, 106, DIG. 2
See application file for complete search history.

(56) References Cited

U.S. PATENT DOCUMENTS 238,945 A 3/1881 Marks
277,744 A 5/1883 Kimball
614,068 A 11/1898 Wetzler
686,699 A 11/1901 Bandler
1,371,841 A 3/1921 Berkwits
1,849,514 A 3/1932 Edelmann
2,075,565 A 3/1937 Allis
2,236,142 A 3/1941 Kaupp
2,486,836 A 11/1949 Garson
2,611,130 A 9/1952 Engelman
2,711,539 A 6/1955 Loscher
3,524,449 A 8/1970 Peters
3,931,816 A 1/1976 Waldmann
4,697,592 A 10/1987 Maddox et al.
5,180,326 A 1/1993 Williams
5,823,851 A 10/1998 Dicker
6,178,784 B1 1/2001 Marley, Jr.
6,345,393 B1 2/2002 Bayer
6,854,132 B1 2/2005 Polzin
7,306,505 B2 * 12/2007 Barbour et al. ..... 450/30
2002/0022433 A1 2/2002 Yeung et al.

* cited by examiner

*Primary Examiner*—Gloria Hale
(74) *Attorney, Agent, or Firm*—Sughrue Mion, PLLC

(57) ABSTRACT

A support garment or support bra includes a first front section having overlapping panels that are visible when the support garment is in a first position. A second front section is provided that is visible when the support garment is turned inside out. The second front section includes a single panel that covers the two overlapping panels. The first front section forms a first silhouette and the second front section forms a second silhouette, such that the first silhouette is visually different than the second silhouette.

24 Claims, 7 Drawing Sheets

REVERSIBLE SPORT BRA

This is a continuation of application Ser. No. 10/901,231 filed Jul. 29, 2004. The entire disclosure of the prior application Ser. No. 10/901,231 is considered part of the disclosure of the accompanying continuation application and is hereby incorporated by reference.

BACKGROUND OF INVENTION

1. Field of Invention

This invention relates to athletic clothing and, more particularly, to a sports top or bra for women that enhances posture by allowing a personal custom fit and provides breast support.

2. Description of the Related Art

Women's athletics have become increasingly popular, causing the industry to produce apparel to meet the needs of female athletes. It is known to provide a sports bra with a customized personal fit that enhances posture and increases breast support for women engaging in athletic activities. However, the prior art has suffered from not sufficiently advancing women's apparel to provide a sports bra that is both fashionable and functional.

Attempts have been made in the past few years to provide a sports bra that is revisable with substantial support. However, no one has created a bra with two attractive, yet different silhouettes that when put together actually add twice the support as a regular reversible bra; while using two different fabrics with different textures and colors.

SUMMARY OF INVENTION

An aspect of the present invention is to provide custom comfort and added support to the wearer. A further aspect is to provide unique visual properties that are functional and aesthetically pleasing. In particular, an illustrative, non-limiting embodiment of the present invention provides a support garment or support bra including a first front section that is visible when the support garment is in a first position. The first front section includes at least two overlapping panels that create additional support and a crisscross section. A second front section is provided that is visible when the support garment is turned inside out. The second front section includes a single panel that covers the two overlapping panels. The first front section forms a first silhouette and the second front section forms a second silhouette, such that the first silhouette is visually and physically different than the second silhouette, in regard to fabrics, textures and colors.

It is also contemplated that the overlapping panels respectively include edges that intersect each other in a crisscross manner such that when the support garment is turned inside out, the second front section becomes an outwardly facing panel and the intersected edges of the overlapping panels are not visible from a front of the support garment.

In accordance with a further illustrative embodiment of the invention, a sports bra is provided that includes a front section and a back section. The front section has an outer panel, a middle panel and an inner panel, wherein the outer panel overlaps at least a portion of the inner panel. The middle panel also overlaps at least a portion of the inner panel and the outer panel may overlap at least a portion of the middle panel. The outer panel and inner panel form a pocket, and the middle panel and inner panel form another pocket.

The inner panel may include a material different from the outer panel and the middle panel. As an example, the inner panel may be a mesh-like material that enhances breath ability including nylon and the outer panel and middle panel may include polyester. It is further contemplated that the inner panel includes two layers fastened to each other around an outer periphery, thereof, by a binding and the back section includes two layers fastened to each other around an outer periphery thereof by a binding. Also, in an embodiment where the back section of the garment includes two layers, one layer may be a mesh-like material including nylon, while the other layer may be polyester.

The outer panel is provided with an edge that overlaps an edge of the middle panel in a crisscross manner such that when the support garment is turned inside out, the inner panel becomes an outwardly facing panel and an intersection of the edges is not visible from a front of the support garment. When the support garment is turned inside out, the rear panel may completely cover the outer and middle panels.

The crisscross feature adds more support to the chest area. The benefits from added support, custom fit and a flattering configuration are provided by the two silhouettes of the bra. Also, sides of the bra may be clean finished to eliminate any possible chafing. In an embodiment, there are no exposed seams as everything is covered with binding or encased between a middle section of the bra.

Even further, a support garment according to the present invention preferably includes a keyhole in the back section. A rim may also be provided that extends around a bottom periphery of the support garment, such that the keyhole extends from a top portion of the rim at a central portion of the back section. In an exemplary embodiment, an area immediately around the hole is the same color as other portions of the back section when the support garment is in a non-reversed position and, when the support garment is in a reversed position, an area immediately around the hole is a different color than other portions of the back section. A double sided branded "manhattan fold" label adds brand identity to both sides.

Also contemplated is a structure where the outer panel and middle panel overlap the inner panel such that a triangular portion of the inner panel is visible from a front of the support garment. The triangular portion may be a different color than the outer panel and inner panel. Further, the triangular portion can have a layer of material that is different than a material of both the outer panel and middle panel. The inner panel adds modesty for the wearer when performing sports such as cycling where the wearer is bending over.

The invention also preferably includes a set of straps that connect the front section to the back section. The set of straps respectively include a first wall and second wall fastened to each other at an outer periphery binding, thereof so that the first wall and second wall are free to separate from each other, except at the area where they are fastened to each other. This, importantly, enables the wearer to customize her fit. Also, a first wall of one strap extends from the outer panel, and the first wall of the other strap extends from the middle panel. The second wall of both straps extends from the inner panel. It is also contemplated that the first and second walls are anchored at a seam on the respective straps and a back portion of the straps extending from the seam to the back section of the support garment includes only one wall. In one embodiment, the back portion of the straps includes two layers of material that are attached to each other around an outer periphery thereof to form the one wall.

BRIEF DESCRIPTION OF THE DRAWINGS

Aspects of the present invention will become more apparent by describing in detail non-limiting embodiments thereof with reference to the attached drawings, in which.

DETAILED DESCRIPTION OF ILLUSTRATIVE NON-LIMITING EMBODIMENTS

The following description of illustrative, non-limiting embodiments of the invention discloses specific configurations and components. However, the embodiments are merely examples of the present invention and, thus, the specific features described below are merely used to more easily describe such embodiments and to provide an overall understanding of the present invention. Accordingly, one skilled in the art will readily recognize that the present invention is not limited to the specific embodiments described below. Furthermore, the descriptions of various configurations, components, processes and operations of the embodiments that are known to one skilled in the art are omitted for the sake of clarity and brevity.

Figure 1:
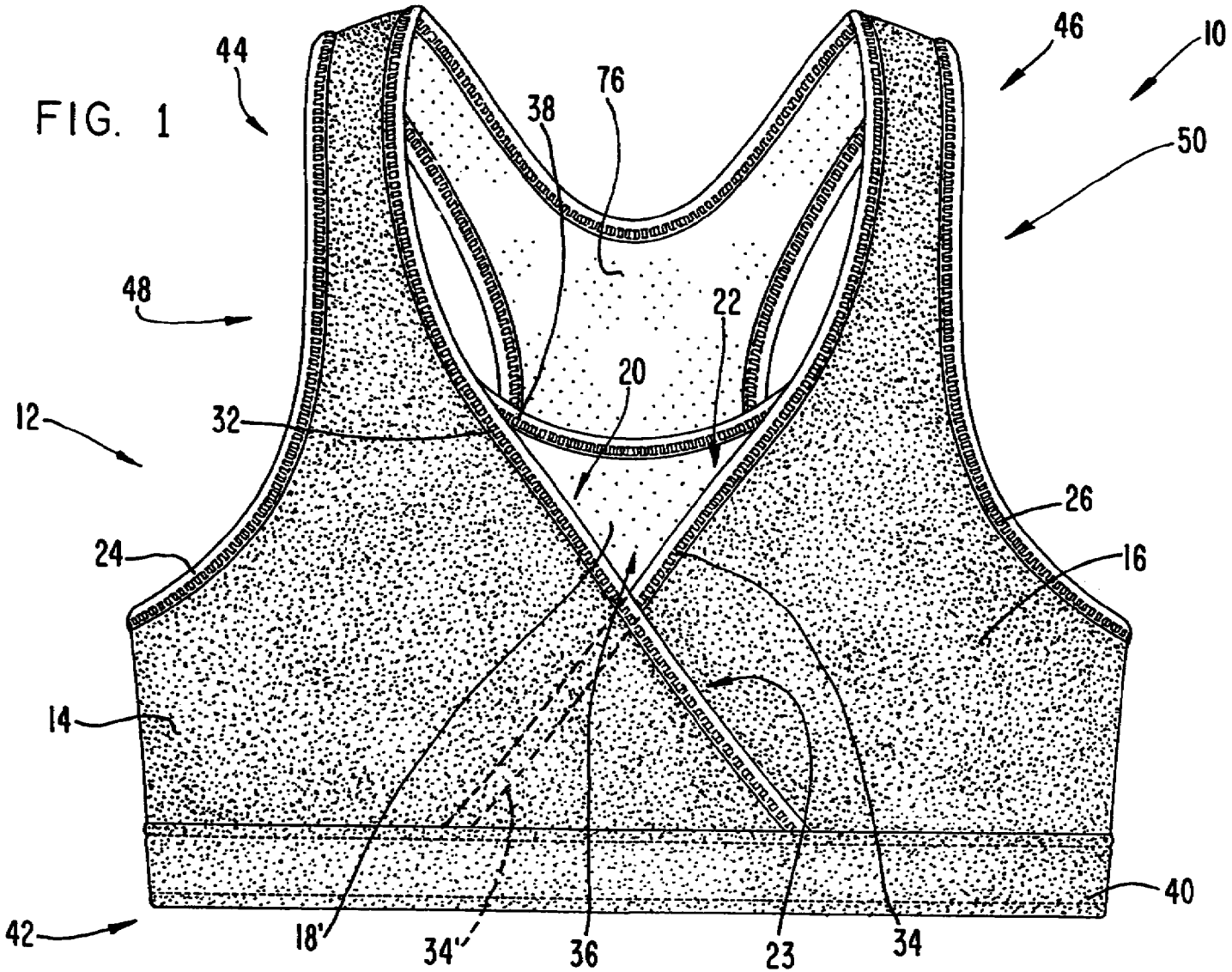
FIG. 1 is a front view of an embodiment of the support garment of the present invention in a first position.
Figure 2:
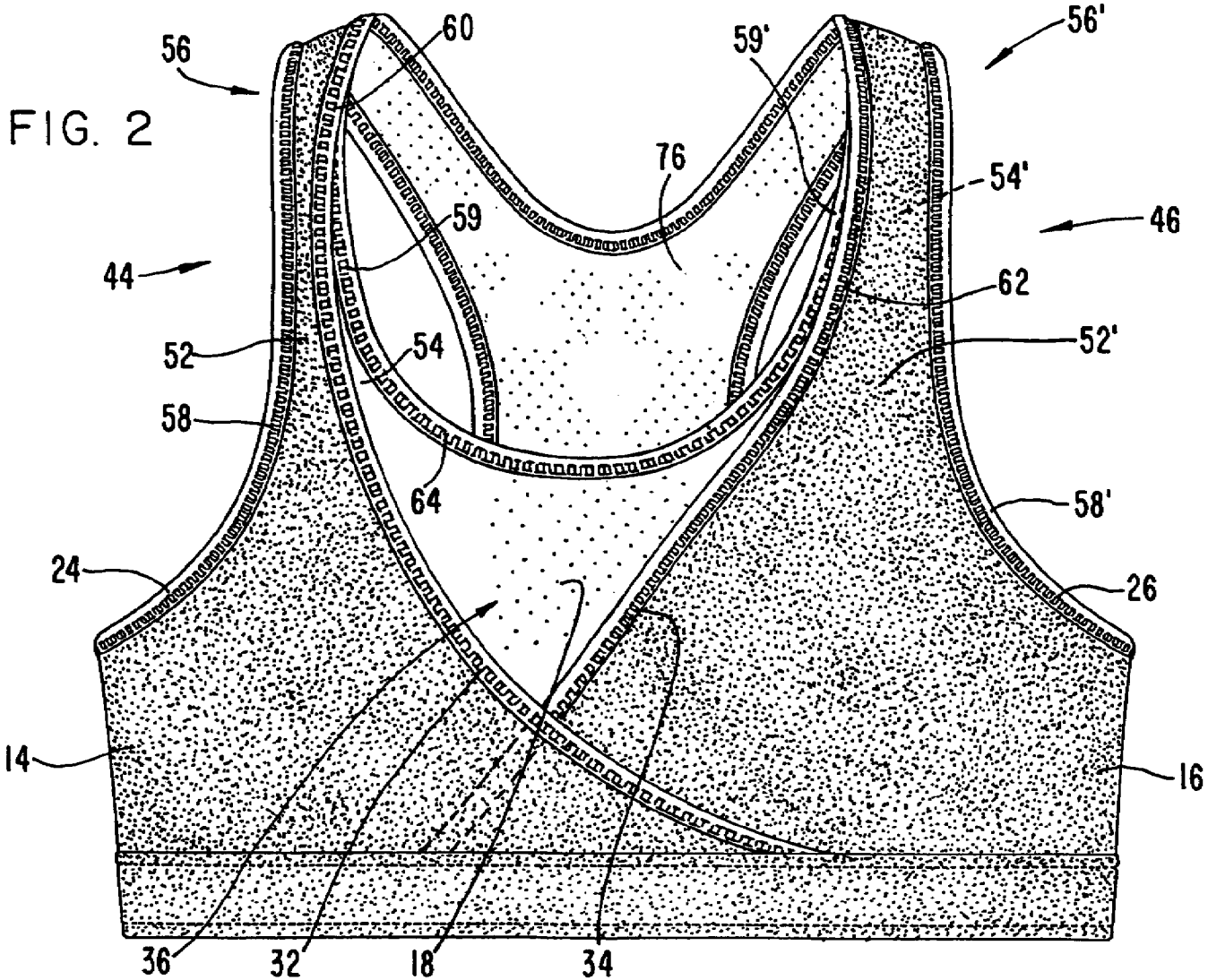
FIG. 2 is a front view of the support garment in FIG. 1, showing a displacement of the straps.

A sports bra 10 according to the present invention provides a combination of functionality and styling to meet the needs of today's female athletes. As shown in FIGS. 1 and 2, the bra 10 is an upper torso breast support garment that has a front section 12 including a front outer panel 14, a front middle panel 16 and a front inner panel 18. It will be appreciated that the term "panel" may include a single layer of material or multiple layers that are attached to each other at peripheral edges.

The front section 12 is visible when the bra is worn in a non-reversed position to form a first silhouette, as represented in FIGS. 1 and 2. The inner panel 18 may act to cover a female's cleavage and be considered a "modesty panel." The front outer panel 14 overlies a portion of the inner panel 18 to provide a first pocket 20. Similarly, the middle panel 16 overlies the inner panel 18 so as to provide a second pocket 22. A portion of the front outer panel 14 also overlies a portion of the middle panel 16 to provide a third pocket 23. The first, second and third pockets 20, 22 and 23 may act as compression pockets or storage areas for holding items, such as money, keys, identification, etc.

The first and second pockets 20, 22 are respectively bordered at side portions by outer reinforced edges 24, 26 to enclose peripheral portions of the pockets 20, 22. The outer edge 24 of the first pocket 20 is coupled together with the outer panel 14 and the inner panel 18. The outer edge 26 of the second pocket 22 is coupled together with the middle panel 16 and the inner panel 18. The compression in the pocket area offers a "no bounce/no move" feature to the pocket that allows it not to have a closure such as Velcro, snap, zipper, etc. The stretch allows for different size items to fit in the bra.

The outer panel 14 and middle panel 16 overlay each other such that an inner edge 32 of the outer panel 14 intersects or overlaps an inner edge 34 of the middle panel 16 to form a crisscross pattern. Only a portion of the edge 34 of the middle panel 16 is visible when viewed from the front in the non-reversed position, while the remaining edge portion 34' is disposed beneath the outer panel 14. The edge portion 34' is not connected to the back of the front outer panel 14. This permits the front outer panel 14, the middle panel 16 and the inner panel 18 to be moveable relative to one another. The crisscross configuration also permits a portion 36 of the inner panel 18 to be visible in an area above the intersected portions of the outer panel 14 and middle panel 16. As shown in FIG. 1, the visible portion 36 of the inner panel 18 may have a triangular-like shape, which adds greatly to the compression and hold for the chest area, and is bordered by the edge 32 of the outer panel 14 and the edge 34 of the middle panel 16, along with an upper edge 38 of the inner panel 18. The positioning of the middle panel 16 on the right and the outer panel 14 on the left, when viewed from the front, is given merely as an example. It will be appreciated that the outer panel may be positioned on the right, while the middle panel is on the left.

Figure 2A:
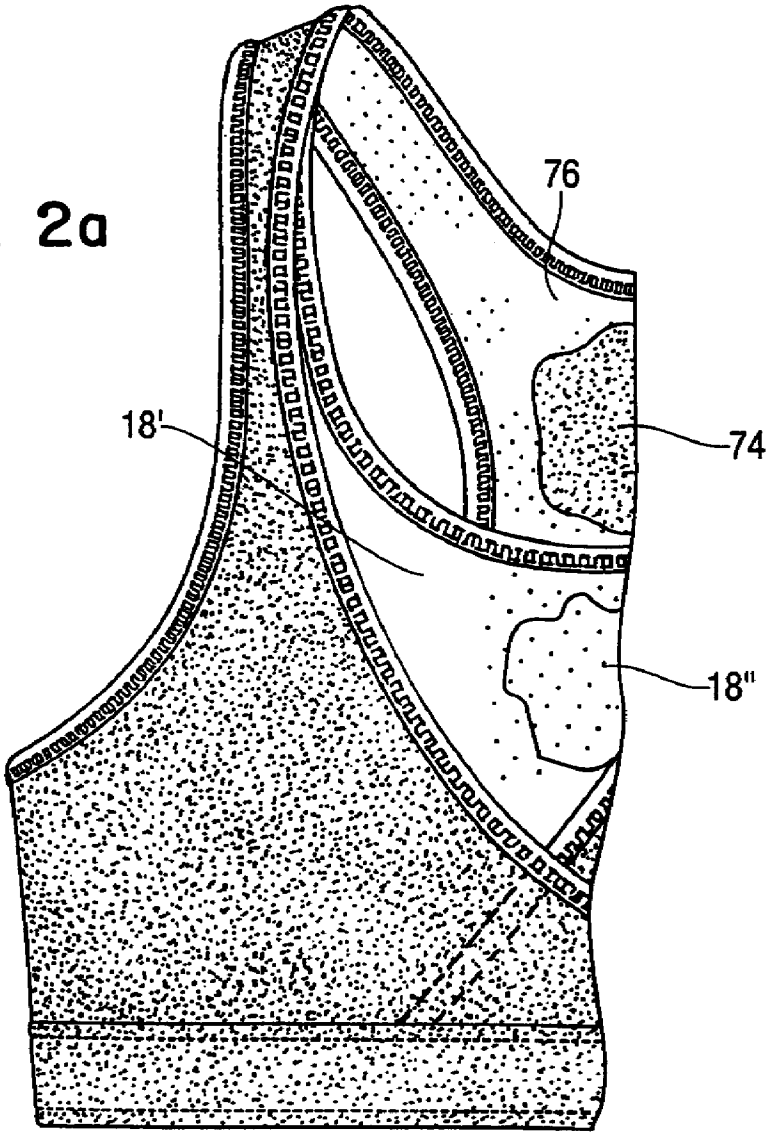
FIG. 2A is a sectional view of FIG. 2, showing exemplary portions of the bra having a two-layer construction.

The edges of the outer, middle and inner panels may be reinforced with a seam or stitching as is known in the art. The stitching provides strength and support to the bra, while being non-abrasive to a user's skin. The use of fluff thread adds to a non-abrasive feel. As shown in FIG. 2A, the inner panel 18 may have a two-layer construction including, for example, a first layer 18' of nylon mesh and a second layer 18" of nylon mesh. The first and second layers 18', 18" may be separable and only attached to each other at edges thereof.

A rim or bust band 40 extends around a bottom periphery 42 of the bra. The rim 40 is formed of an encased elastic material that provides a snug fit with the user's upper body. When worn, the rim 40 is positioned beneath the breast area and helps maintain the position of the bra. The rim 40 also provides a common meeting point where bottom portions of the outer panel 14, middle panel 16 and inner panel 18 are stitched together.

Figure 3:
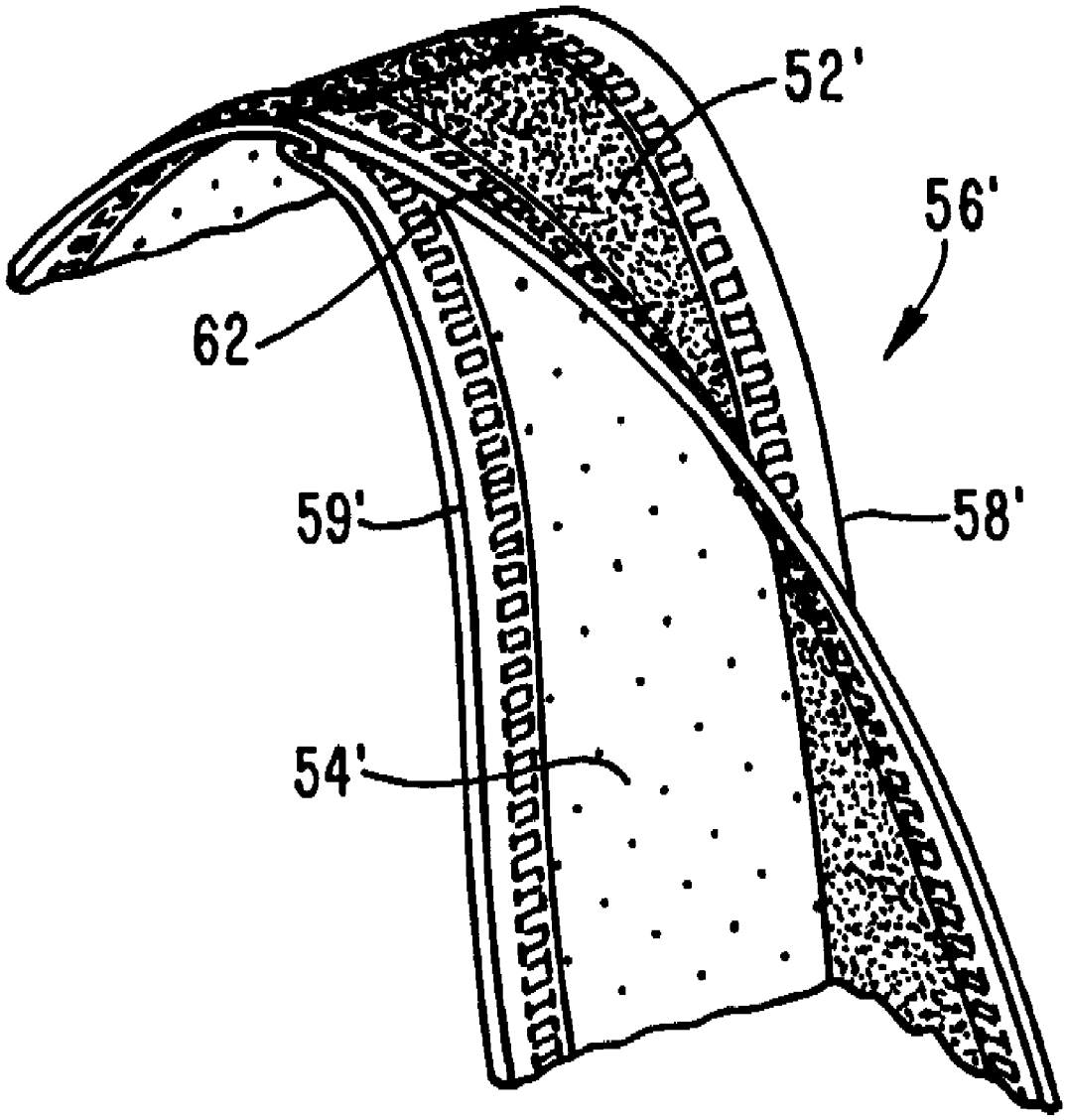
FIG. 3 is an enlarged view of the portion of the straps in FIG. 2.

With continued reference to FIG. 1, the bra 10 is provided with a left front strap 44 and a right front strap 46. The terms "left" and "right" are used herein to describe sides viewed when facing the view shown in FIGS. 1 and 2. The left and right front straps 44, 46 respectively encircle shoulder portions of a user to provide left and right arm holes 48, 50. With reference to FIG. 2, in an exemplary embodiment, the left and right front straps 44, 46 are each formed with first walls 52, 52' and second walls 54, 54', that are connected along an outer side of the straps 44, 46. FIG. 3 is provided to illustrate a close-up view of the first wall 52' and second wall 54' of the right strap 46. The first wall 52' of the right front strap 46 extends from the middle panel 16, and the first wall 52 of the left front strap 44 extends from the outer panel 14. It will be appreciated that the right front strap 46 may extend from the outer panel 14, and the left front strap 44 from the middle panel 16 depending on the sides of the bra on which these panels are positioned. The second walls 54, 54' of the front straps 44, 46 extend from the inner panel 18.

The straps respectively have an outer side 56, 56' bordered with an edge 58, 58'. The edges 58, 58' provide stable/minimal stretch support and strength to the bra 10, as well as connecting together the first walls 52, 52' and second walls 54, 54' around the edges of the arm holes 48, 50 of the bra.

This configuration allows a separation between the first walls 52, 52' and the second walls 54, 54' from a shoulder area to a chest area, so as to provide a custom fit and adjustability. As shown in FIG. 2, the outer edges 24, 26 of the first and second pockets 20, 22 follow the outer contour of the bra 10 to merge with edges 58, 58' of the straps 44, 46.

An inner edge 60 of the first wall 52 of the left front strap 44 is an extension of the inner edge 32 of the outer panel 14. An inner edge 62 of the first wall 52' of the right front strap 46 is an extension of the inner edge 34 of the middle panel 16. Inner edges 59, 59' of the second walls 54, 54' follow a curved path so as to join together and form a border of a neck hole 64.

In an exemplary embodiment, the outer panel 14 and middle panel 16, along with the first walls 52, 52' of the left and right straps 44, 46, may be made of a polyester fabric with moisture-wicking properties, such as HEATGEAR provided by Under Armour. For example, the fabric may comprise 6 oz/yd$^2$ micro-denier polyester/elastane warp knit tricot fabric that will wick moisture from the body and include a 76% 40 denier dull polyester and 24% 55 denier spandex knit. The high spandex content allows for the stretch and support needed in a sports bra fabric. The fabric may be a tricot construction at a 60" width. The mean warp stretch may be 187% at 10 lbs of load, and the mean width stretch may be 90% at 10 lbs of load. An example of the mean stitch count is 16 stitches per inch for flat seams at sides and tops of the straps; and 16-18 stitches per inch for remaining areas. This fabric also may have a wicking finish applied to it. Although this material is given as an example, it will be appreciated that other materials known in the art can be used.

In further accordance with an exemplary embodiment, the inner panel 18 may be made of a brushed mesh material, which is a beneficial feature for providing ventilation and support. In particular, the brushed mesh may be a supportive, yet breathable 6 oz/yd$^2$ nylon/elastane circular knit mesh. This fabric may also be treated with a wicking finish in order to wick moisture from the body. The combination of nylon and polyester allows for a push/pull technology that will keep the athlete supported and dry. More specifically, the nylon mesh may be 92% 2-ply 70 denier 68 filament micro-denier nylon and 8% spandex. The mesh construction may be knit on a 28 gauge machine and finished at 60" width. The mean length stretch of the product may be 105%, and the mean width stretch may be 170%, at 10 lbs of load. The fabric stitch count in an illustrative embodiment is 61 courses per inch and 40 wales per inch. Although this material is given as an example, it will be appreciated that other materials known in the art can be used.

As will be appreciated, the elements that make up the front silhouette, shown in FIGS. 1 and 2, may be provided with various color schemes. In an exemplary embodiment, the outer 14 and middle 16 panels, along with the first walls 52, 52' of the straps, are the same color, while the portion of the inner panel 18 that is visible between the outer panel 14 and middle panel 16 is a different color. An inside portion 76 may also be a different color than the outer panel 14, middle panel 16 and inner panel 18. The edges of the panels visible in the front silhouette may also be the same color as the front and middle panels.

Figure 4:
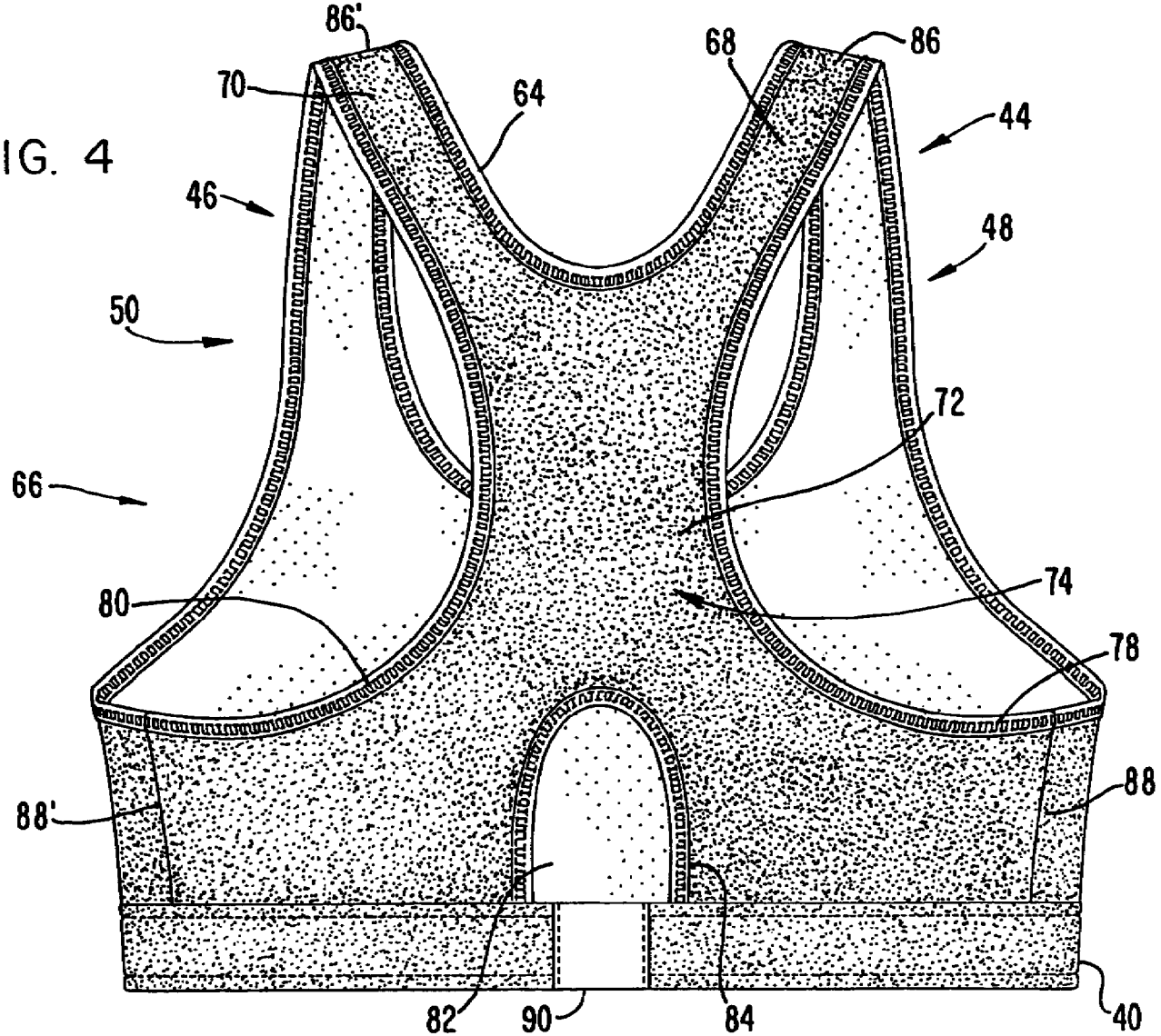
FIG. 4 is a back view of the support garment of FIG. 1.

FIG. 4 shows a back section 66 of the bra 10 in a non-reversed state. The back section 66 of the bra includes a left back strap 68 and a right back strap 70 that respectfully extend from the left front strap 44 and the right front strap 46. In the back view, the left and right designations will be used to correspond to those used in the front views. The left and right back straps 68, 70 converge in a center of the bra to form a main rear panel 72. As shown in FIG. 2A, the main rear panel 72 may have a two-layer construction including the aforementioned polyester fabric on the outside 74 and the nylon mesh on the inside 76. The two layers may be separable and only attached to each other at edges thereof.

With continued attention to FIG. 4, the main rear panel 72 is bound on its sides by the arm-holes 48, 50 and is bound at an upper area by the neck hole 64. Edges 78, 80 of the respective arm-holes 48, 50 extend around an outer periphery thereof so as to continue to the front section 12 of the bra 10 and merge with the outer peripheral edges of the straps 54, 54', which then merge with outer edges 24, 26 of the first and second pockets 20, 22. In a lower center section of the bra 10, shown in FIG. 4, there is provided a keyhole 82 that extends through the main rear panel 72 and is bounded by a reinforced edge 84. The rim 40 continues around the back of the bra and provides a boundary for the keyhole 42.

The left and right front straps 44, 46 are respectively connected to the corresponding left and right rear straps 68, 70 at seams 86, 86' to form a junction therebetween. In an exemplary embodiment, the left and right rear straps 68, 70 have a one-wall construction in contrast to the first wall 52, 52' and second wall 54, 54' construction of the front straps 44, 46. It will be appreciated that the use of the term "wall" herein may include a single layer of material or multiple layers that are attached to each other at peripheral edges.

A lower part of the back section 66 of the bra 10 is connected to the front portion 12 at seams 88, 88'. One seam 88 serves as a junction between the main rear panel 72, inner panel 18 and outer panel 14, while the other seam 88' may serve as a junction between the main rear panel 72, inner panel 18 and middle panel 16. The main rear panel 72 is also bound at a bottom portion by the rim 40. The rim or bust band 40 may include a strip of a specific-stretch elastic material that is connected at both ends to form a loop. This connection may be in the form of a seam or may be made by a manhattan fold or tab 90 that is sewn to the strip to bridge together the respective ends in an area of the keyhole 82. As an example, the tab 90 may fold over the respective ends of the rim 40 and be stitched in place. The tab 90 may also serve as a location to display a dual logo or name and be wide enough for ideal support while not too wide to constrict breathing. A logo can be placed on both sides of the tab or manhattan fold 90. The tab 90 wraps around the rim 40 to stabilize the fabrics on both sides of the rim 40 and is stitched to the rim 40 on sides of the tab 90. The tab 90 also includes a portion which is tucked under itself to conceal an end thereof.

In an exemplary embodiment, the back section 66 of the bra 10 has a uniform color. However, it is contemplated that elements such as the main rear panel 72, or edges thereof, in addition to the reinforced edge 84 of the keyhole 82 and rim 40, may have varying colors to further distinguish the bra's look. As will be appreciated, various color schemes may be used to change the appearance of the bra.

Figure 5:
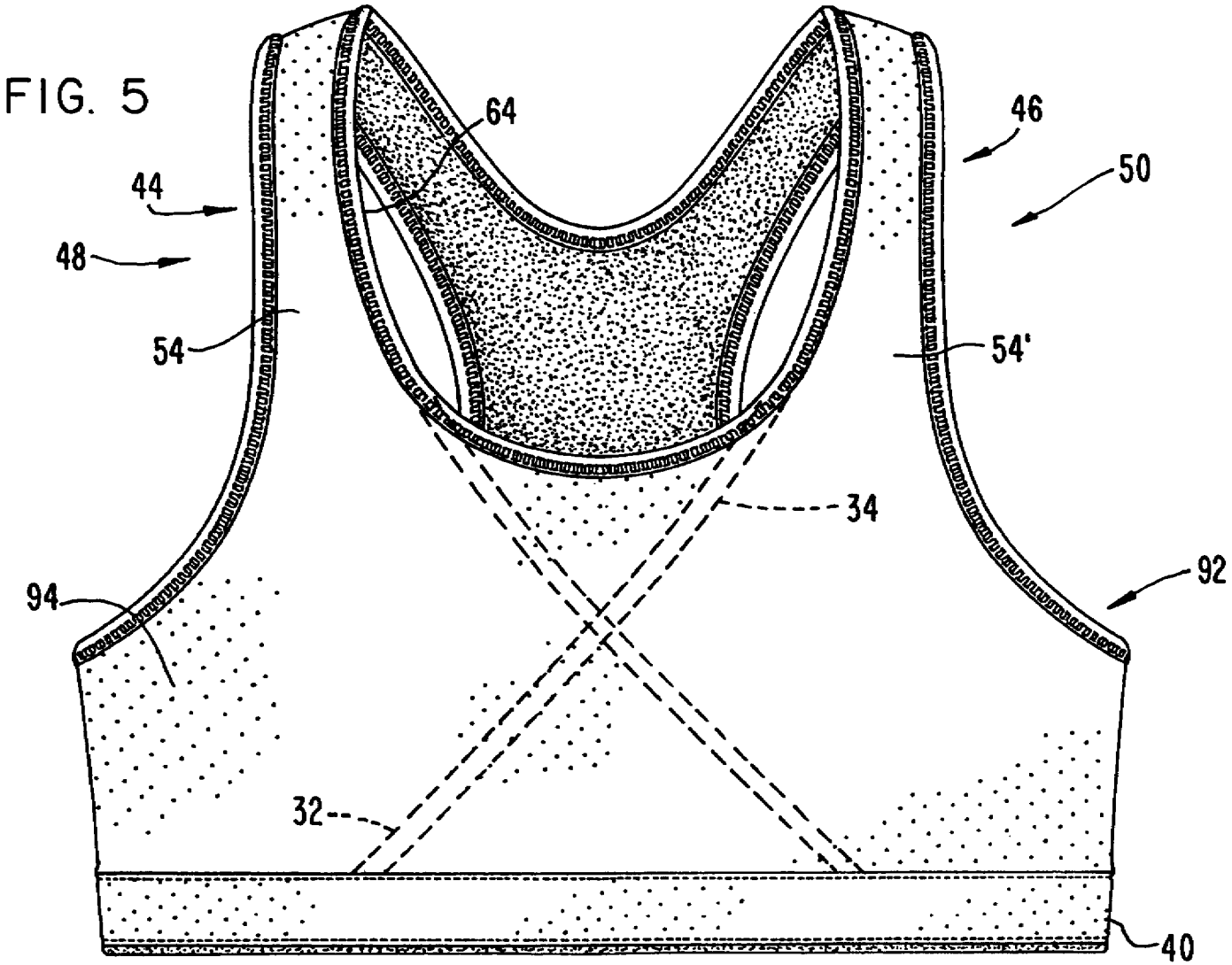
FIG. 5 is a front view of the support garment of FIG. 1 in an inside-out position.

Turning to FIG. 5, the bra 10 is shown in a reversed or inverted state relative to the state shown in FIG. 1 with a front section 92 of the bra 10 forming a second silhouette. With the first silhouette shown in FIG. 1 along with the second silhouette shown in FIG. 5, a user has the luxury of owning one bra that provides two different looks. As an example, such a feature is useful for providing different styles and for distinguishing between members of two teams. All of the players on a field could be wearing a sports bra in accordance with the present invention with the players on one team wearing the bra in a manner showing one silhouette and the players on the other team wearing the bra in a manner showing the other silhouette. The distinction between the two teams could be further enhanced by the use of different color schemes for the different silhouettes of the sports bra in accordance with the invention.

Accordingly, the front section 15 forms a first visual configuration in the first position which outwardly displays the outer panel 14 as visibly overlapping the middle panel 16, and displays the middle panel 16 as visibly overlapping the inner panel 18 when viewed from a front of the support garment, as shown in FIG. 1. The second front section 92 forms a second visual configuration in the second position when the support garment is reversed, such that the one of the two layers of the inner panel 18 which faces outwardly in the second reversed position conceals the middle panel 16 and the outer panel 14 when the bra 10 is viewed from the front.

The front section 92 in the reversed state includes a single main front panel 94 that extends across the width of the front section 92 and upward on left and right sides of the main front panel 94 to form the right and left straps 44, 46. The main front panel 94, shown in FIG. 5, is the reverse side of the inner panel 18 shown in FIGS. 1 and 2, and thus may have the same color and be made of the same material. However, only the main front panel 94 is visible in the reversed state because the inner panel 18 and the middle panel 16 are now on the inside of the bra 10. Likewise, the left and right straps 44, 46 have the same configuration as described in reference to FIG. 1, but with the first walls 52, 52' now being on an inside, and the second walls 54, 54' being on the outside.

The first and second pockets 20, 22 are accessible when the bra 10 is used in the reversed state and are provided with the added security of front main panel 92, which further conceals the pockets 20, 22. Also, the rim 40 is shown as being attached to an outer portion of the bra 10, when the bra 10 is in the non-reversed state. However, it will be appreciated that the rim 40 can also be attached to an outer portion of the bra 10 in the reversed state.

The edge of the neck-hole 64 and the edges of arm-holes 48, 50 are visible when the bra is used in the reversed state and may be a different color than the main front panel 94 to even further distinguish the second silhouette from the first silhouette. Also, because the inner panel 18 shown in FIG. 1 and the main front panel 94 shown in FIG. 5 comprise two layers, it is possible that those two layers may have different colors to even further differentiate the look of the bra when in the reversed and non-reversed states.

Figure 6:
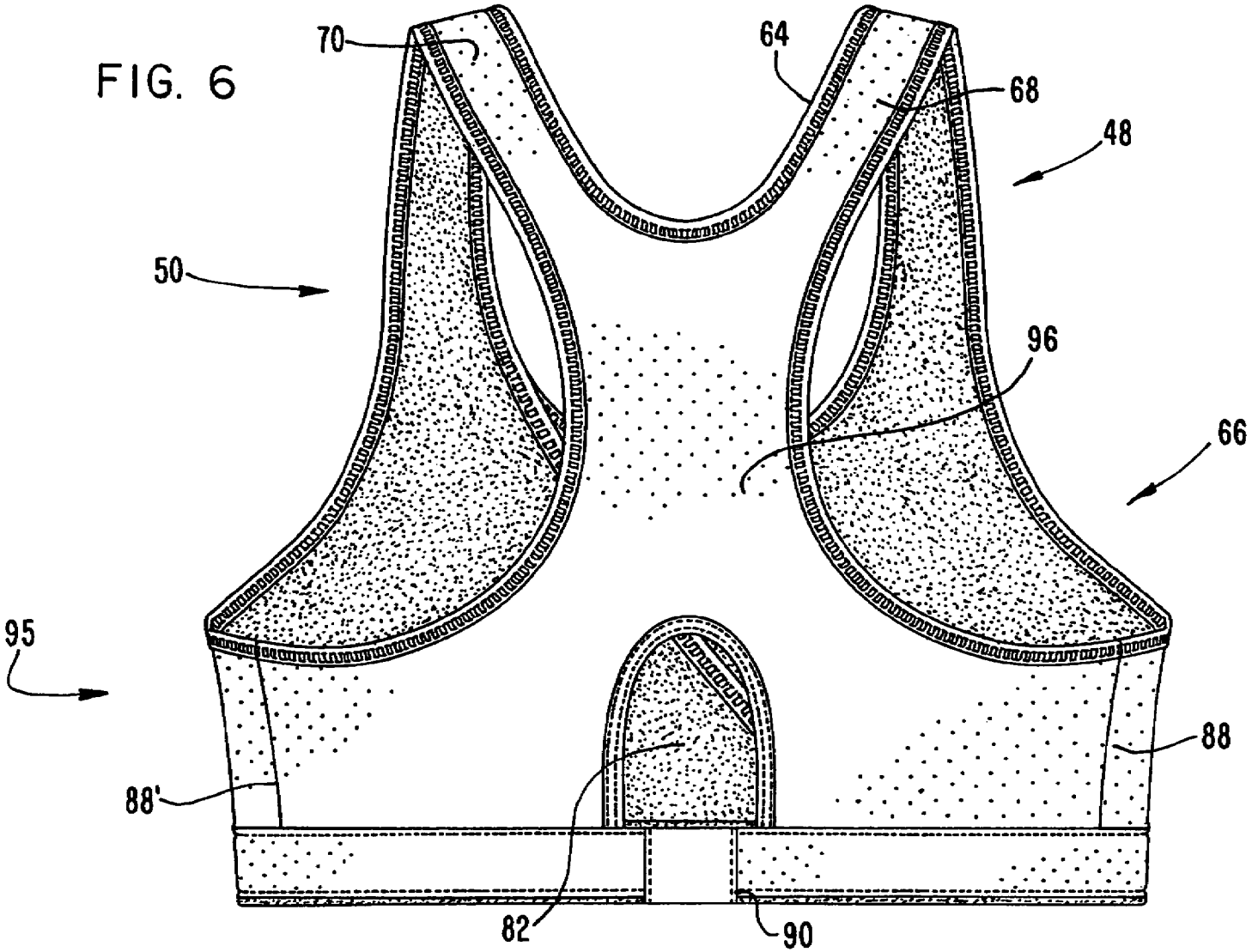
FIG. 6 is a back view of the support garment of FIG. 1 in the inside-out position.

FIG. 6 represents a rear view of a back section 95 of the bra 10 while in the reversed state. The back section 95 includes a main rear panel 96 that extends upwardly to form the left and right back straps 68, 70, in a manner similar to the main rear panel 72 in the non-reversed state. As noted above, the main rear panel 72 in the non-reversed state may have a two-layer construction including the aforementioned polyester fabric on the outside and the nylon mesh on the inside. Thus, when the bra is in the reversed state, as shown in FIG. 6, the nylon mesh forms the main rear panel 96 and is visible on the outside, while the polyester fabric is provided on the inside.

The seams 88, 88' that couple the back section 66 of the bra to the front section 12 may also be visible when the bra 10 is reversed. Also, the keyhole 82 is shown with a bordered area having a color different from the main portion of the back 96. Similar to the front section 92 shown in FIG. 5, the edges of the neck-hole 64, keyhole 82 and arm-holes 48, 50 may be a different color than the main rear panel 96 to even further distinguish the first silhouette from the second silhouette. Further, the tab 90 is also visible when the bra is in the reversed state.

With reference to FIG. 1, it will be appreciated that a particularly advantageous feature of the sports bra 10 in accordance with the present invention is the ability of the outer and middle panels 14, 16 to move and stretch independently of each other, as well as the inner panel 18. The ability of these panels to move independently is because, as shown more clearly in FIG. 2, the edge 32 of the outer panel 14 is not fixed to the middle panel 16 or the inner panel 18. Similarly, the edge 34 of the middle panel 16 is not fixed to the outer panel 14 or the inner panel 18. As a result, when the sports bra 10 is worn by a user, the edge 60, for example, does not lay directly on top of the edge 59. Instead, the panels 14, 16 and 18 will be stretched when the bra 10 is worn such that the edges 59 and 60 will lay adjacent to each other for a substantial portion of the length, whereby those two edges would rest on top of each other when not in use. The edges 59' and 62 will be positioned in a similar manner. The independent movement of the panels 14, 16 and 18 also provides for a generally increased level of comfort for the user.

The previous description of the preferred embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty. Therefore, the present invention is not intended to be limited to the embodiments described herein, but is to be accorded the widest scope as defined by the limitations of the claims and equivalents thereof.

What is claimed is:

1. An upper torso breast support garment that is reversible from a first position to a second position, the garment comprising:

a first front section which is visible when the support garment is in the first position, the first front section having a fabric outer panel, a fabric middle panel and a fabric inner panel, the outer panel having an edge that overlaps an edge of the middle panel in a crisscross manner, the middle panel overlapping at least a portion of the inner panel, such that the inner panel is overlapped by the outer and middle panels; wherein the inner panel is adapted to be closer to a user's skin than the middle panel and the outer panel when the support garment is in the first position, a second front section which is visible when the support garment is reversed so as to be turned inside out in the second position, the second front section comprising the inner panel which faces outwardly and covers the middle and outer panels when the support garment is in the second position; wherein the outer panel is adapted to be closer to the user's skin than the middle panel and the inner panel when the support garment is in the second position, a bust band attached to a bottom periphery of the outer panel, the middle panel, and the inner panel to provide support for the user's breasts;

a set of shoulder straps respectively comprising a first wall including a periphery and a second wall including a periphery, wherein the periphery of the first wall is fastened to the periphery of the second wall so that the first and second walls are free to separate from each other except at the periphery where they are fastened to each other, the first wall of one of the shoulder straps extends from the outer panel, and the first wall of the other strap extends from the middle panel, the second wall of both of the shoulder straps extends from the inner panel, the first and second walls being anchored at a seam on the shoulder straps respectively, and the set of shoulder straps respectively have a rear portion that extends from the seam to the back section.

2. The support garment of claim 1, wherein the first front section forms a first visual configuration in the first position which outwardly displays the outer panel as visibly overlapping the middle panel, and displays the middle panel as visibly overlapping the inner panel when viewed from a front of the support garment, and the second front section forms a second visual configuration in the second position when the support garment is reversed, such that the inner panel conceals the middle panel and the outer panel when the support garment is viewed from the front.

3. The support garment according to claim 1, wherein the edges of the outer and middle panels intersect each other such that when the support garment is turned inside out in the second position, an intersection of the edges is not visible from a front of the support garment.

4. The support garment according to claim 1, wherein when the support garment is turned inside out, the rear panel completely covers the outer and middle panels.

5. The support garment according to claim 1, wherein the outer and middle panels overlap the inner panel such that a triangular portion of the inner panel is visible from a front of the support garment when in the first position.

6. The support garment according to claim 5, wherein the triangular portion is a different color than the outer and inner panels.

7. The support garment according to claim 6, wherein the triangular portion has a layer of material which is different than a material of both the outer and middle panels.

8. The support garment according to claim 1, wherein the outer and inner panels overlap to form a storage pocket.

9. The support garment according to claim 1, wherein the middle and inner panels overlap to form a storage pocket.

10. The support garment of claim 1, wherein the outer panel overlaps a portion of the middle panel, such that the outer panel, the middle panel and the inner panel are separately flexible.

11. The support garment of claim 1, wherein the inner panel includes an edge, the edges of the outer and middle panels are fixed to the edge of the inner panel only at upper ends of the edges of the outer panel, the middle panel and the inner panel, so that the outer panel, the middle panel and the inner panel are separately flexible independent of one another.

12. The support garment of claim 1, wherein a label is wrapped around the bust band.

13. An upper torso breast support garment comprising:

a front section which includes a fabric outer panel, a fabric middle panel and a fabric inner panel that lie over one another;

a back section;

a bust band attached to a bottom periphery of the outer panel, the middle panel, and the inner panel to provide support for a user's breasts, and a set of shoulder straps connecting the front section to the back section;

wherein the outer panel overlaps at least a portion of the inner panel;

wherein the inner panel is adapted to be closer to the user's skin than the middle panel and the outer panel when the support garment is in a first position;

wherein the outer panel and middle panel overlap the inner panel such that a portion of the inner panel is visible from a front of the support garment, the portion of the inner panel being a triangular portion; and wherein the triangular portion has a layer of material which is different than a material of both the outer panel and middle panel.

14. The upper torso breast support garment of claim 13, wherein the inner panel comprising the triangle portion is a mesh-like material including nylon and the material of the outer panel and the middle panel comprise polyester.

15. An upper torso breast support garment comprising:

a front section which includes a fabric outer panel, a fabric middle panel and a fabric inner panel that lie over one another;

a back section;

a bust band attached to a bottom periphery of the outer panel, the middle panel, and the inner panel to provide support for a user's breasts, and a set of shoulder straps connecting the front section to the back section;

wherein the outer panel overlaps at least a portion of the inner panel;

wherein the inner panel is adapted to be closer to the user's skin than the middle panel and the outer panel when the support garment is in a first position;

wherein the back section includes two layers fastened to each other around an outer periphery thereof; and wherein the two layers of the back section comprise a material, and one layer of the back section is a mesh-like material including nylon and the other layer includes polyester.

16. An upper torso breast support garment comprising:

a front section which includes a fabric outer panel, a fabric middle panel and a fabric inner panel that lie over one another;

a back section; and a bust band attached to a bottom periphery of the outer panel, the middle panel, and the inner panel to provide support for a user's breasts, wherein the inner panel is adapted to be closer to the user's skin than the middle panel and the outer panel when the support garment is in a first position;

wherein the outer panel overlaps at least a portion of the inner panel;

further including a set of shoulder straps which connect the front section to the back section; and wherein the set of shoulder straps respectively include a first wall including a periphery and second wall including a periphery, wherein the periphery of the first wall is fastened to the periphery of the second wall so that the first wall and second wall are free to separate from each other except at the periphery where they are fastened to each other.

17. The upper torso breast support garment according to claim 16, wherein the first wall and second wall are separable from each other to permit a size of the support garment to be adjusted.

18. The upper torso breast support garment according to claim 16, wherein the first wall of one of the shoulder straps extends from the outer panel, and the first wall of the other of the shoulder straps extends from the middle panel.

19. The upper torso breast support garment according to claim 18, wherein the second wall of both shoulder straps extends from the inner panel.

20. The upper torso breast support garment according to claim 16, wherein the first and second walls are anchored at a seam on the respective shoulder straps and a portion of the shoulder straps extending from the seam to the back section of the support garment includes only one wall.

21. The upper torso breast support garment according to claim 20, wherein the only one wall includes at least two layers of material that are attached to each other around an outer periphery thereof.

22. An upper torso breast support garment comprising:

a front section which includes a fabric outer panel, a fabric middle panel and a fabric inner panel that lie over one another; wherein the inner panel is adapted to be closer to the user's skin than the middle panel and the outer panel when the support garment is in a first position;

a back section;

a set of shoulder straps connecting the front section to the back section; and a bust band attached to a bottom periphery of the outer panel, the middle panel, and the inner panel to provide support for a user's breasts;

wherein a first wall of one of the shoulder straps extends from the outer panel, and a first wall of the other of the shoulder straps extends from the middle panel and the inner panel.

23. The upper torso breast support garment of claim 22, wherein the set of shoulder straps respectively include the first wall and a second wall, the first wall including a periphery and second wall including a periphery, wherein the periphery of the first wall is fastened to the periphery of the second wall so that the first wall and second wall are free to separate from each other except at the periphery where they are fastened to each other.

24. The upper torso breast support garment according to claim 22, wherein the second wall of both shoulder straps extends from the inner panel.

* * * * *